US010359722B2

(12) United States Patent
Suzuki et al.

(10) Patent No.: US 10,359,722 B2
(45) Date of Patent: Jul. 23, 2019

(54) FIXING DEVICE HAVING AN ELASTIC PAD AND A PAD HOLDER HAVING A PORTION THAT IS SPACED FROM THE ELASTIC PAD

(71) Applicant: CANON KABUSHIKI KAISHA, Tokyo (JP)

(72) Inventors: Masahiro Suzuki, Numazu (JP); Koji Uchiyama, Mishima (JP); Tomonori Sato, Hamamatsu (JP)

(73) Assignee: Canon Kabushika Kaisha, Tokyo (JP)

( * ) Notice: Subject to any disclaimer, the term of this patent is extended or adjusted under 35 U.S.C. 154(b) by 0 days.

(21) Appl. No.: 16/005,908

(22) Filed: Jun. 12, 2018

(65) Prior Publication Data

US 2018/0364624 A1 Dec. 20, 2018

(30) Foreign Application Priority Data

Jun. 14, 2017 (JP) ..... 2017-116741

(51) Int. Cl.
*G03G 15/20* (2006.01)
*G03G 15/00* (2006.01)
*G03G 15/08* (2006.01)

(52) U.S. Cl.
CPC ..... *G03G 15/2053* (2013.01); *G03G 15/0865* (2013.01); *G03G 15/206* (2013.01); *G03G 15/2064* (2013.01); *G03G 15/605* (2013.01); *G03G 15/6511* (2013.01); *G03G 15/6555* (2013.01)

(58) Field of Classification Search
CPC ..... G03G 15/2017; G03G 15/2021; G03G 15/2028; G03G 15/2053; G03G 15/2064
USPC ..... 399/323, 329
See application file for complete search history.

(56) References Cited

U.S. PATENT DOCUMENTS

| | | | | |
|---|---|---|---|---|
| 9,207,602 | B2 * | 12/2015 | Hatazaki | G03G 15/2064 |
| 9,804,542 | B2 * | 10/2017 | Hidaka | G03G 15/2028 |
| 9,983,527 | B2 | 5/2018 | Yamashita et al. | |
| 2013/0202334 | A1 | 8/2013 | Takahashi | |

FOREIGN PATENT DOCUMENTS

| | | | |
|---|---|---|---|
| JP | 2005-331574 | A | 12/2005 |
| JP | 2006-113609 | A | 4/2006 |
| JP | 2013-160908 | A | 8/2013 |
| JP | 2014-191123 | A | 10/2014 |

* cited by examiner

*Primary Examiner* — William J Royer
(74) *Attorney, Agent, or Firm* — Venable LLP

(57) ABSTRACT

A fixing device includes a pad and a holder that holds the pad at a side opposite from a side on which the pad opposes a rotatable member. The holder includes a first portion provided at a position in which a recording material is separated from the rotatable member, with a gap being provided between the pad and the first portion with respect to a recording material feeding direction, and a second portion that holds the pad and extends in the recording material feeding direction. In addition, a leaf spring member urges the holder toward the rotatable member. Further, a recording material, carrying a toner image thereon, is nipped and fed through a nip, formed by sandwiching an endless belt between the rotatable member and the pad, and the toner image is fixed on the recording material in the nip.

12 Claims, 6 Drawing Sheets

FIXING DEVICE HAVING AN ELASTIC PAD AND A PAD HOLDER HAVING A PORTION THAT IS SPACED FROM THE ELASTIC PAD

This application claims the benefit of Japanese Patent Application No. 2017-116741, filed Jun. 14, 2017, which is hereby incorporated by reference herein in its entirety.

FIELD OF THE INVENTION AND RELATED ART

The present invention relates to a fixing device and is applied to an image forming apparatus, such as a copying machine, a facsimile machine, or a printer, employing an electrophotographic type process, for example.

A constitution in which, in the fixing device, a fixing nip is formed by causing a pressing member, backed up by a metal stay, to press-contact (press) an endless belt toward a fixing roller as a rotatable member has been known. Japanese Laid-Open Patent Application No. 2005-331574 proposes a method in which pressure concentration is reduced by sandwiching an elastic member between a pressure pad and the metal stay and thus, pressure release at a periphery of a pressure concentration portion and breakage of the pressing member are avoided.

As another fixing device, a fixing device in which, as a pressing member for forming a nip in cooperation with a rotatable member via an endless belt while opposing the rotatable member, first and second pressing members are provided and are spaced from each other with respect to a recording material feeding direction, has been known (Japanese Laid-Open Patent Application No. 2014-191123).

In Japanese Laid-Open Patent Application No. 2005-331574, however, in a case in which a local pressure concentration occurs at an elastic member and thus, the elastic member is compression-deformed, a pressure pad also swings correspondingly thereto. That is, compression of the elastic member due to a thickness of paper (sheet) as a recording material occurs with every paper (sheet) passing, so that the pressure pad swings. At this time, the pressure pad slides on a stay. When this phenomenon is repeated, the pressure pad is abraded by the sliding, so that a position of the pressure pad shifts to a downstream side with respect to a recording material feeding direction, with the result that improper separation of the recording material at a downstream end of the nip occurs.

Further, also in Japanese Laid-Open Patent Application No. 2014-191123, suppression of the improper separation of the recording material at the downstream end of the nip is not taken into consideration.

SUMMARY OF THE INVENTION

A principal object of the present invention is to provide a fixing device capable of ensuring a good durability and a separating property of a recording material from a rotatable member in order to solve the above-described problem.

According to an aspect, the present invention provides a fixing device comprising a rotatable member, a rotatable endless belt contacting a surface of the rotatable member, a pad provided in an inside space of the endless belt and configured to press the rotatable member through the endless belt, a holder configured to hold the pad at a side opposite from a side on which the pad opposes the rotatable member, wherein the holder includes a first portion provided at a position in which a recording material is separated from the rotatable member with respect to a recording material feeding direction, and a second portion that holds the pad and that extends in the recording material feeding direction, and a leaf spring member configured to urge the holder toward the rotatable member, wherein between the rotatable member and the endless belt, a nip, in which the recording material, carrying a toner image thereon, is nipped and fed, is formed by sandwiching the endless belt by the rotatable member and the pad, and the toner image is fixed on the recording material in the nip, and wherein, with respect to the recording material feeding direction, a gap is provided between the pad and the first portion.

Further features of the present invention will become apparent from the following description of exemplary embodiments with reference to the attached drawings.

DESCRIPTION OF EMBODIMENTS

Embodiments of the present invention will be specifically described with reference to the drawings.

First Embodiment

Image Forming Apparatus

Figure 1:
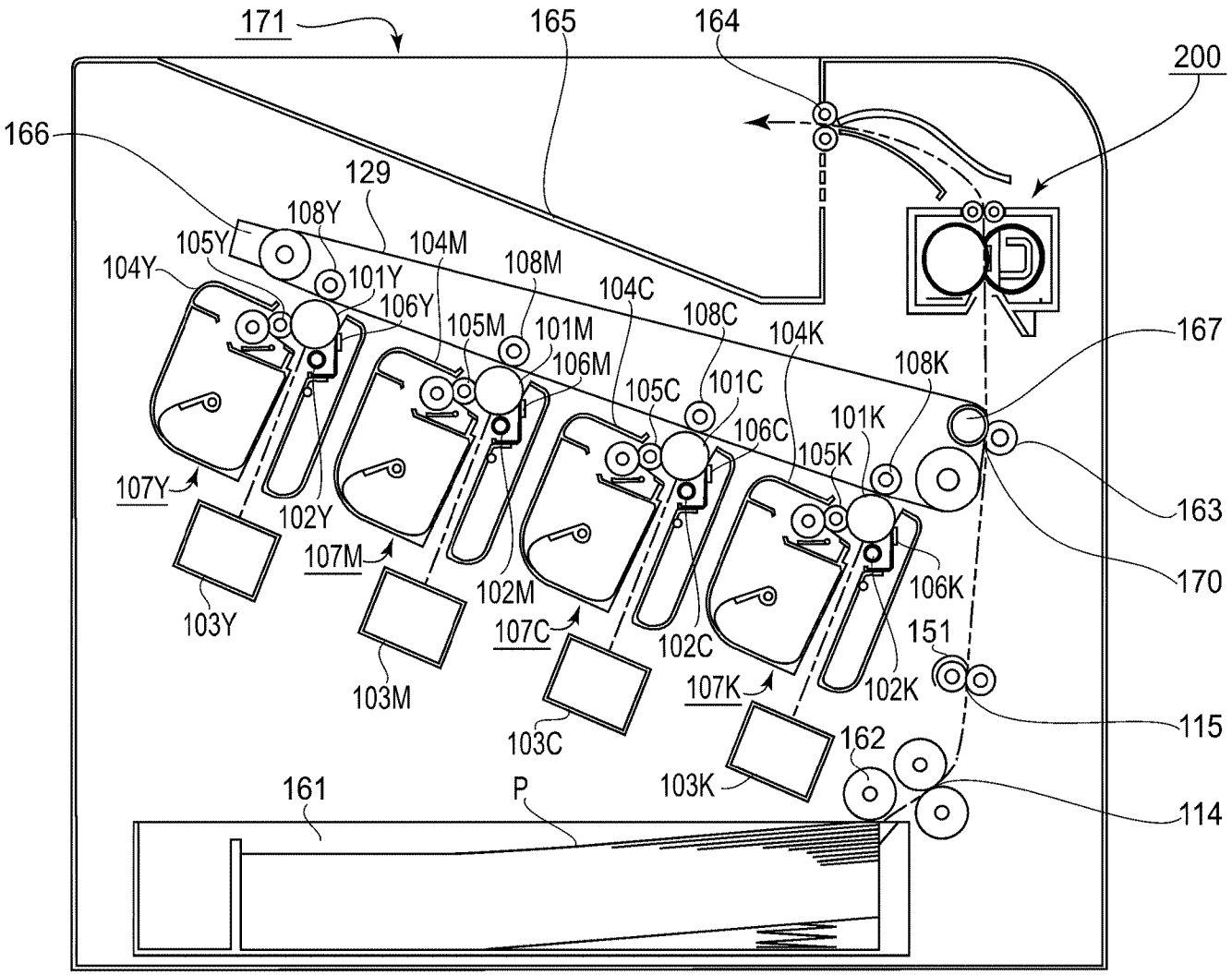
FIG. 1 is a schematic structural view of an image forming apparatus in which a fixing device according to an embodiment of the present invention is mounted.

FIG. 1 is a schematic sectional view showing a general structure of a full-color laser beam printer 171, which is an example of an image forming apparatus, in which a feeding device (apparatus) 200, according to this embodiment of the present invention, is mounted. As the image forming apparatus, the full-color laser beam printer 171 including a plurality of photosensitive drums will be described, but the present invention is not limited thereto. The present invention is also applicable to a monochromatic copying machine or a printer in which a single photosensitive drum is mounted.

In FIG. 1, at a lower portion of the printer 171, a sheet (paper) feeding cassette 161 is accommodated in a pullable state. Recording sheets (recording papers) P, as recording materials stacked and accommodated in the sheet feeding cassette 161, are fed from the sheet feeding cassette 161 by a pick-up roller 162, as a feeding means. Then, the recording sheets P are separated one by one by a feeding/retarding roller pair 114, and the separated recording sheet P is fed to a registration roller pair 115. Operation timing of the pick-up roller 162 is controlled by an unshown control means for recording sheet feeding.

The registration roller pair 115 is provided with a registration shutter 151, as a recording sheet detecting means, which is provided rotatably about a registration roller shaft. When the recording sheet P enters the registration roller pair 115, the registration shutter 151 is pushed up and rotated by a leading end of the recording sheet P. The rotation of the registration shutter 151 at this time is detected by an unshown photo-sensor, or the like, whereby timing when the recording sheet P enters the registration roller pair 115 can be grasped.

The printer 171 includes image forming stations 107Y, 107M, 107C, and 107K as image forming portions corresponding to colors of yellow, magenta, cyan, and black, respectively.

The image forming stations 107Y, 107M, 107C, and 107K respectively include photosensitive drums 101Y, 101M, 101C, and 101K as image bearing members, charging devices 102Y, 102M, 102C, and 102K, laser scanners 103Y, 103M, 103C, and 103K as exposure means, developing devices 104Y, 104M, 104C, and 104K, primary transfer portions 108Y, 108M, 108C, and 108K, and cleaning blades 106Y, 106K, 106C, and 106K.

Incidentally, as regards reference symbols representing the respective members, suffixes Y, M, C, and K added subsequently to numerals show the colors of the image forming stations in which the associated members are provided, and the members represented by the same reference numerals have substantially no difference in operation. Therefore, in the following description, the suffixes Y, M, C, and K will be omitted from the reference symbols.

The charging device 102 electrically charges a surface of the photosensitive drum 101 uniformly. The charged surface of the photosensitive drum is irradiated with a laser beam by the laser scanner 103 on the basis of image information, so that an electrostatic latent image is formed on the photosensitive drum 101. The developing device 104 incorporates a developing roller 105, and the developing roller 105 deposits toner on the electrostatic latent image formed on the photosensitive drum 101, so that the electrostatic latent image is developed with the toner into a toner image. The primary transfer portion 108 transfers the toner image from the photosensitive drum 101 onto an intermediary transfer belt 129. The cleaning blade 106 removes the toner remaining on the photosensitive drum 101 without being transferred by the primary transfer portion 108.

The toner images transferred on the intermediary transfer belt 129 by the primary transfer portions 108 are transferred onto the recording sheet P at a secondary transfer portion 170 formed by an opposite roller 167 and a secondary transfer roller 163. Secondary transfer residual toner remaining on the intermediary transfer belt 129 without being transferred onto the recording sheet P at the secondary transfer portion 170 is removed and collected by a belt cleaning device 166. The recording sheet P passed through the secondary transfer portion 170 then passes through a fixing device 200, as the fixing device (apparatus) according to the present invention, so that the toner images are fixed on the recording sheet P.

The recording sheet P, on which the toner images are fixed, is thereafter fed to a discharging roller pair 164. After the recording sheet P passes toner the discharging roller pair 164, the recording sheet P is discharged onto a recording sheet stacking portion 165.

Fixing Device

Figure 2:
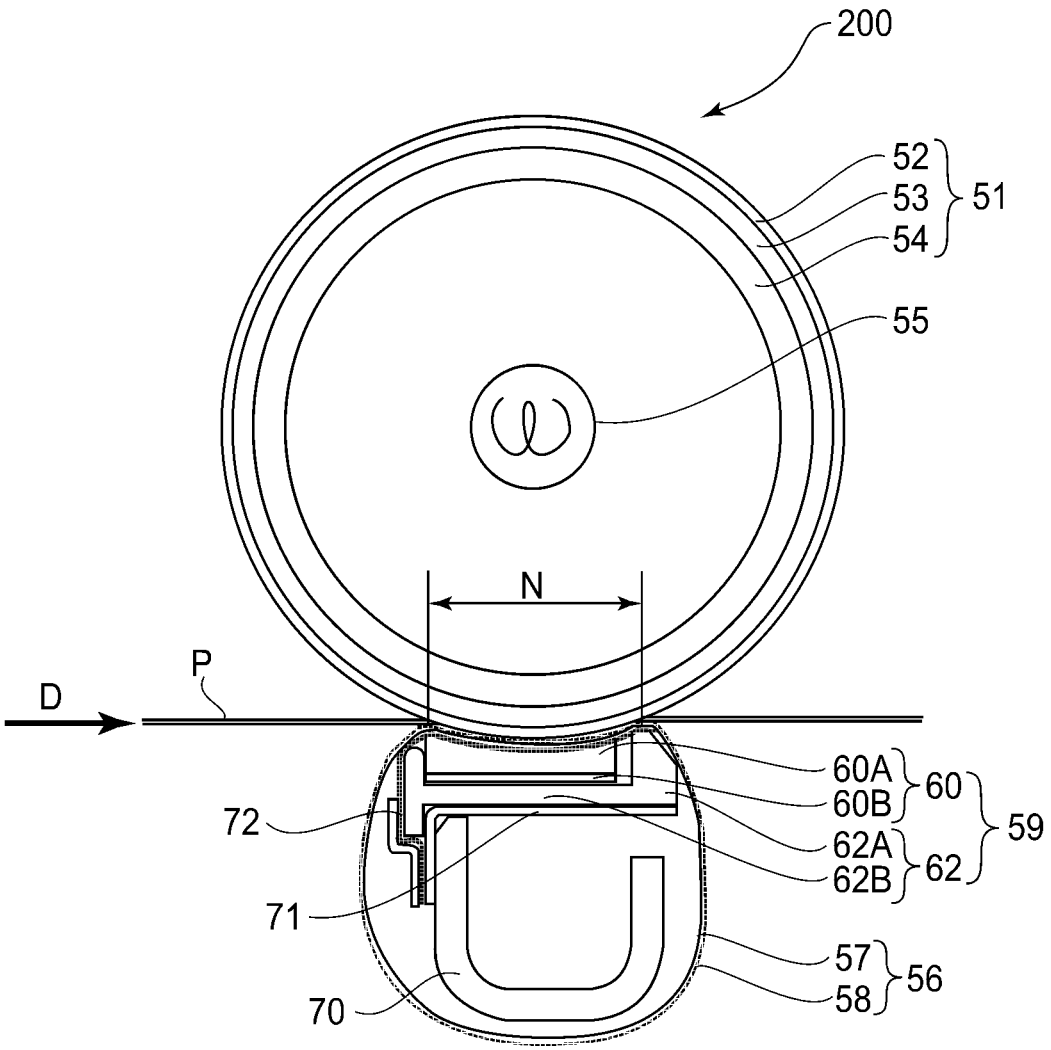
FIG. 2 is a cross-sectional side view of a principal part of a fixing device according to a First Embodiment.

FIG. 2 is a cross-sectional side view of a principal part of the fixing device 200 of a heat roller type as the fixing device according to this embodiment of the present invention. An arrow D direction refers to a feeding direction of the recording sheet P, as a recording material. Further, herein, a longitudinal direction is a direction crossing (perpendicular to) the recording material feeding direction and to a recording material thickness direction.

A heat roller (rotatable member) 51 is constituted by laminating, around a bare tube 54 formed of metal in a cylindrical shape (cylindrical metal core), an elastic layer 53 and a parting layer 52 that have heat-resistant properties. The bare tube 54 is constituted by a cylindrical member formed of metal, such as iron, aluminum, or stainless steel (SUS), having high thermal conductivity (in this embodiment, a thin high-tension steel pipe is used).

As a material of the elastic layer 53, any material can be used when a resultant member is a high heat-resistant elastic member. Particularly, the elastic member, such as a rubber or an elastomer of 25 degrees to 40 degrees in rubber hardness (JIS-A), may preferably be used. Specifically, a silicone rubber, a fluorine-containing rubber, or the like, can be used.

As a material of the parting layer 52, any resin material may be used when the resin material is a heat-resistant material, and, for example, a silicone resin material or a fluorine-containing material can be used, but, from the viewpoint of a parting property of the toner from the parting layer 52 and anti-wearing property thereof, the fluorine-containing resin material is suitable. As the fluorine-containing resin material, it is possible to use tetrafluoroethylene-perfluoroalkyl vinyl ether copolymer (PFA), polytetrafluoroethylene (PTFE), tetrafluoroethylene-hexafluoropropylene copolymer (FEP), and the like.

A thickness of the parting layer 52 may preferably be 10 μm to 50 μm, and, more preferably, may be 10 μm to 30 μm. This is because when the thickness of the parting layer 52 is less than 10 μm, the recording sheet P is liable to cause creases due to distortion of the heat roller 51. On the other hand, when the thickness of the parting layer 52 exceeds 30 μm, the parting layer 52 becomes hard, so that a possibility that uneven glossiness, or the like, occurs on the image increases. Thus, the thicknesses out of the range (10 μm to 30 μm) are not preferred.

Inside the heat roller 51, a halogen lamp 55, as a heat generating source (heating source, heat source), is provided. Incidentally, to the surface of the heat roller 51, an unshown temperature sensor is contacted. On the basis of a measured temperature value by this temperature sensor, an unshown controller of the image forming apparatus controls turning-on of the halogen lamp 55 so that a surface temperature of the heat roller 51 is maintained at a predetermined set temperature (e.g., 170° C.).

A pressing film 56, as an endless belt, is rotated by receiving power from the heat roller 51 while press-contacting the heat roller 51. This rotatable pressing film 56 is constituted by a base layer 57 and a parting layer 58 coated on an outer peripheral surface of the base layer 57. The base layer 57 is formed of a heat-resistant resin material, such as polyimide, polyamide, or polyimideamide, or of metal, such as SUS, nickel, or copper, and a thickness thereof is 30 μm to 200 μm, preferably about 50 μm to 100 μm. The parting layer 58 is formed of a fluorine-containing resin material, such as PFA, PTFE, or FEP, and a thickness thereof is 5 μm to 100 μm, preferably be about 10 μm to 30 μm.

The pressing film 56 is press-contacted to the heat roller 51 with a predetermined pressure by a pressing member 59, provided in an inside space thereof, through a low-friction sheet 72. The pressing film 56 is rotatably supported by flanges 12 (12*a*, 12*b*) provided at longitudinal end portions thereof, and described later.

The pressing member 59 causes the pressing film 56 to press (press-contact) the heat roller 51 through the low-friction sheet 72, so that a nip, in which the recording material P is nipped and fed, is formed between the pressing film 56 and the heat roller 51. The pressing film 56 is sandwiched by the heat roller 51 and the pressing member 59, whereby the nip N, in which the recording material P, carrying thereon the toner image, is nipped and fed, is formed between the roller 51 and the pressing film 56. In the nip N, the toner image is fixed on the recording material P.

The pressing member 59 includes an elastic pad member 60 including an elastic pad 60A as a first pressing member, and a pad holder 62, including a downstream jaw portion 62A as a second pressing member. The downstream jaw portion 62A is provided at a position spaced from the elastic pad 60A with respect to the recording material feeding direction, although will be described specifically later. The recording material P, reduced in press-contact force (recording sheet) in a spaced region (gap), is separated from the heat roller 51 at a position corresponding to the downstream jaw portion 62A.

Figure 3:
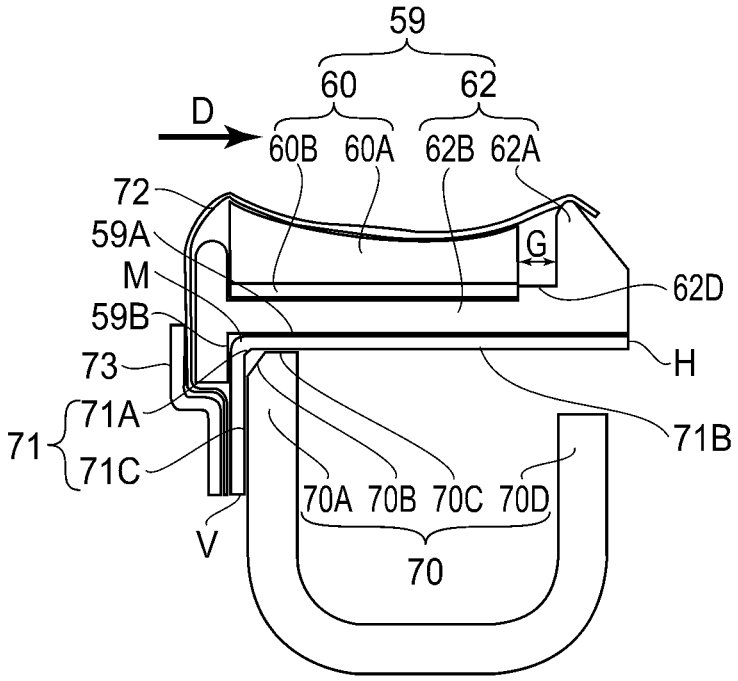
FIG. 3 is a cross-sectional side view of members provided inside a pressing film of the fixing device according to the First Embodiment.

FIG. 3 is a cross-sectional side view of members provided inside the pressing film 56 of the fixing device 200 in this embodiment. The elastic pad member 60 is provided from an entrance side of the nip N toward a downstream side with respect to the recording material feeding direction. The elastic pad member 60 ensures a broad nip N with respect to a recording material feeding direction D, and has a function of causing the recording sheet P to increase in temperature.

The elastic pad member 60 is constituted by the elastic pad 60A and a rigid pad supporting plate 60B as a supporting member for the elastic pad 60A. The elastic pad member 60 is prepared by bonding the pad supporting plate 60B, which is a flat plate member formed of metal, to a bottom of the elastic pad 60A, formed in a substantially prism shape. By providing the rigid pad supporting plate 60B, ease of handling thereof as a component part of the elastic pad member 60 is achieved. The elastic pad 60A can be constituted by an elastic material, such as a silicone rubber or a fluorine-containing rubber, having a heat-resistant property. In this embodiment, the elastic pad 60A is constituted by the silicone rubber, and the pad supporting plate 60B is constituted by SUS.

The pad holder 62 integrally includes the downstream jaw portion 62A, as a first portion, and a pad receiving portion 62B, as a second portion, for supporting and fixing the elastic pad member 60 from the lower surface side of the elastic pad member 60. The downstream jaw portion 62A is provided on a downstream exit side of the nip N with respect to the feeding direction D. The downstream jaw portion 62A is locally press-contacted to the pressing film 56 strongly toward the heat roller 51, so that the elastic layer 53 and the parting layer 52 of the heat roller 51 are elastically deformed. By this deformation, the recording sheet P, on which the toner image is formed, can be peeled (separated) from the surface of the heat roller 51.

A free end portion of the downstream jaw portion 62A is sharpened so that a large pressure can be locally applied to the heat roller 51. In this embodiment, a free end of the downstream jaw portion 62A contacting a pressing surface has an outwardly (convexly) curved surface corresponding to R0.5. Further, the pad receiving portion 62B is formed in a rectangular groove shape correspondingly to a size of the elastic pad member 60 on a side upstream of the downstream jaw portion 62A with respect to the feeding direction D. The elastic pad member 60 is engaged in the pad receiving portion and thus, is fixed to (supported by) the pad holder 62.

The pad holder 62, including the downstream jaw portion 62A, is constituted by a material harder than the material of the elastic pad 60A. That is, the elastic pad 60A is constituted by the material softer than the material of the downstream jaw portion 62A. The pad holder 62, including the downstream jaw portion 62A, can be formed of a heat-resistant resin material, such as polyphenylene sulfide, polyimide, polyamideimide, polyester, or liquid crystal polymer (LCP), or of a metallic material, such as iron, SUS, or aluminum. The pad holder 62 in this embodiment is constituted by the LCP.

Here, as shown in FIG. 3, in this embodiment, the downstream jaw portion 62A is spaced from the elastic pad 60A with respect to the recording material feeding direction D and is provided at a downstream position of the nip N with respect to the recording material feeding direction D, so that the recording sheet P, reduced in press-contact force (pressure) in a spaced region (gap G), is separated from the heat roller 51. It is confirmed in an experiment that a separating property of the recording sheet P is improved by the gap (spacing) G, although this will be described specifically later.

When a width of the gap G is excessively narrow, an effect on the separating property of the recording sheet P is reduced. On the other hand, when the width of the gap G is excessively broad, not only the effect on the recording sheet separating property is saturated but also an area of a low nip pressure portion is excessively increased and thus, a fixing property lowers. The pressing member 59 is provided so that the elastic pad 60 is disposed on the pad holder 62 so as to provide the width of the gap G of 1 mm. The width of the gap G may preferably be set in a range of 0.8 mm to 2 mm.

In this embodiment, the pad holder 62 is provided with a gap rib (spacer portion) 62D (FIG. 3), for forming the gap G, formed in the neighborhood of the base portion of the downstream jaw portion 62A. A distance of the gap G can be maintained with high accuracy by abutting and fixing the pad supporting plate 60B, which is a supporting member for the elastic pad 60A, to the gap rib 62D. In such an embodiment, on the downstream side of the nip N, downstream ends of the elastic pad 60A and the pad supporting plate 60B coincide with each other with respect to the recording material feeding direction D. Incidentally, as shown in FIG. 3, the spacer portion 62D projects from a level of a region (second portion) 62B in which the pad holder 62 holds (supports) the elastic pad 60 in a direction toward the heat roller 51.

Figure 4:
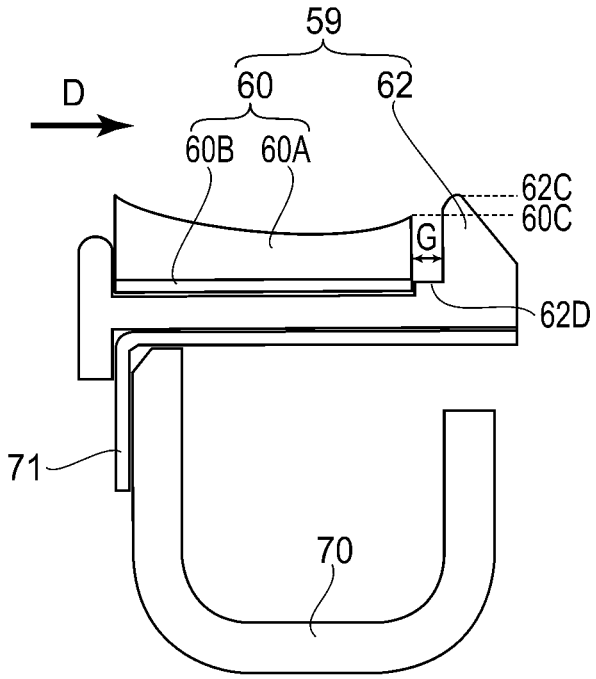
FIG. 4 is a schematic view showing a shape of an elastic pad member during non-pressure application in the First Embodiment.

FIG. 4 is a schematic view showing a shape of the elastic pad 60 in a state in which the pressing member 59 is not press-contacted to the heat roller 61. An upper surface, of the elastic pad 60A, which is the pressing surface, has a concave shape so as to follow a shape of the outer peripheral surface of the heat roller 51. As a result, the nip N formed by the elastic pad 60A can be extended in the feeding direction D of the recording material P, so that a fixing performance can be enhanced.

In this embodiment, during a period in which the elastic pad 60A is under no pressure, a portion 60C of the elastic pad 60A, which is the pressing surface (press-contact surface) on the gap G side, is disposed lower than a portion 62C, of the downstream jaw portion 62A, which is the pressing surface (press-contact surface) on the gap G side. That is, when the pad 60 and the pad holder 62 are demounted from the fixing device 200, with respect to a height in a direction toward the roller 51, the downstream end portion 60C of the pad 60 with respect to the recording material feeding direction D is lower than the first portion 62A of the pad holder 62.

This is because when the portion 60C of the elastic pad 60A is higher than the portion 62C of the downstream jaw portion 62A, the elastic pad 60A is considerably deformed during the press-contact to the heat roller 61 and enters the gap G and thus, an effect of improving the recording sheet separating property by the gap G lowers.

Next, members for supporting the pressing member 59 will be described using FIG. 3. The pressing member 59 is supported by a stay 70, as a fixing member, having rigidity to some extent, and a leaf spring member 71 provided on the stay 70 in order to apply a pressing force (pressure) for forming the nip N over a longitudinal direction of the pressing member 59. The stay 70 is a member prepared by bending a steel plate in a U-character shape and is formed of a steel material, such as a zinc-plated steel plate (trade name: "ZINC CHROMATE COAT", manufactured by NIPPON STEEL & SUMITOMO METAL CORPORATION) or SUS304. Of the U-character shape in cross section, an upstream portion 70A with respect to the feeding direction is formed so as to have a longer shape than a downstream portion 70D with respect to the feeding direction.

At a free end portion of the upstream portion 70A with respect to the feeding direction, a chambered portion 70B is formed and has a shape such that interference with a bent portion 71A positioned inside the leaf spring member 71 is avoided. The stay 70 supports the leaf spring member 71 at a contact portion 70C with the leaf spring member 71. The leaf spring member 71 is fixed at the contact portion 70C to a side surface of the stay 70 by an unshown screw.

Further, the pressing member 59 is contact-supported and positioned by the leaf spring member 71 by surfaces 59A and 59B.

Next, the leaf spring member 71 will be described with reference to FIG. 3 and FIG. 5, which is a perspective view of a principal part thereof.

The leaf spring member 71 has an L-character shape such that a bent portion M is provided between a first end portion V and a second end portion H in a cross section perpendicular to the longitudinal direction (rotational axis direction) shown in FIG. 3. Further, a third portion (corresponding to the first region 71C) extending from the bent portion M to the first end portion V is provided along a direction that is perpendicular to the recording material feeding direction and that is oriented from the rotatable member toward the endless belt. Further, with respect to the recording material feeding direction, the bent portion M positioned upstream of the second end portion H opposes an upstream position of the second portion 62B, and a fourth portion (corresponding to the second region 71B) extending from the bent portion M to the second end portion H is provided along the recording material fixing. Further, leaf spring member 71 supports the pressing member 59 at the fourth portion.

Here, the stay 70 is formed so that, with respect to the recording material feeding direction D, a downstream leg (foot) portion 70D is shorter than an upstream leg (foot) portion 70A. Further, the stay 70 fixes at least a part of the third portion (corresponding to the first region 71C) of the leaf spring member 71 so that the second end portion H is displaceable as a free end about the bent portion M. That is, only one end portion side (only the first end portion V side) of the first end portion V side and the second end portion H side of the leaf spring member 71 is fixedly supported by the stay 70. Further, the stay 70 fixes the pad holder 62A on a side upstream, with respect to the recording material feeding direction D, of a center position of the nip N via the leaf spring member 71.

Figure 5:
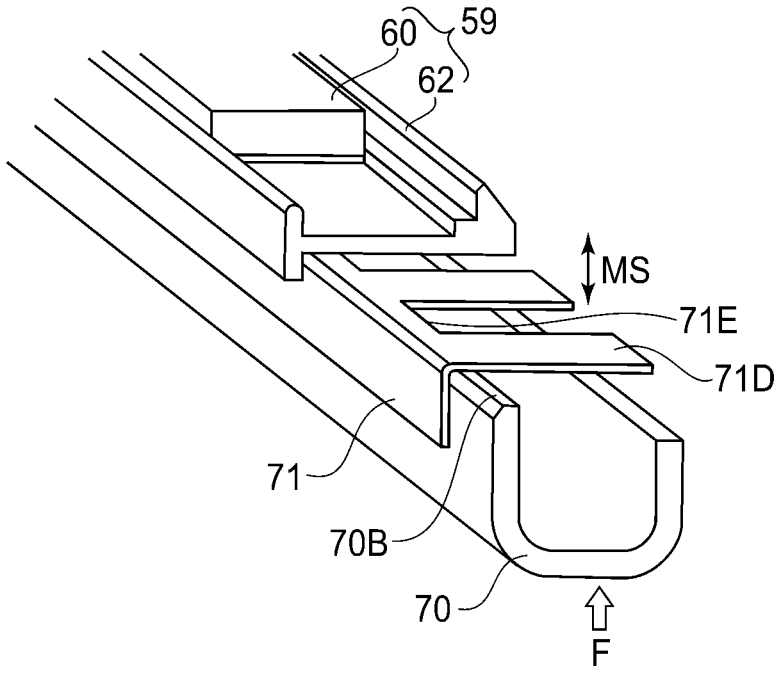
FIG. 5 is a perspective view of the members disposed inside the pressing film of the fixing device according to the First Embodiment.

Further, as shown in FIG. 5, the leaf spring member 71 has a shape such that the leaf spring member 71 is molded in a comb teeth shape with respect to the longitudinal direction. Leaf spring member portions 71D are portions corresponding to teeth of the comb-teeth, and leaf spring member portions 71E are base portions of the comb-teeth shape, in which the comb teeth are cut away. The leaf spring member portions 71D are cantilevers supported by a leaf spring supporting portion 70C of the stay 70. When the recording sheet P enters the nip N, additional pressure corresponding to a thickness of the recording sheet P is applied to the pressure member 59 through the pressing film 56, so that the leaf spring member portions 71D receiving the pressure from the pressing film 56 swing in an arrow MS direction. At this time, the pad holder 61 is also flexed. As a result, the additional pressure by the recording sheet P can be released (eliminated), so that an increase in pressure of the nip N by the recording sheet P can be reduced.

As described above, the leaf spring member 71 has a cut-away shape defined by the portions 71D and 71E (FIG. 5) along the longitudinal direction. By employing such a constitution, the teeth 71D can be placed in a state in which a plurality of discrete teeth 71D are disposed along the longitudinal direction, not a state in which the teeth 71D are disposed over the longitudinal direction in a continuous manner. As a result, the discrete teeth 71D are swingable independently of each other.

For example, in the case in which a thick recording sheet P, such as an envelope, having a short width with respect to the longitudinal direction, enters the nip N, a high pressure is locally exerted on lateral edges of the recording sheet P in some instances. In such a case, when a constitution, such as the constitution as in this embodiment, in which the plurality of teeth 71D, which are cantilevers swingable independently of each other, are provided, is employed, a swing amount of the teeth 71D can be changed depending on the pressure exerted in the longitudinal direction, so that such a situation that the pressure is locally exerted on the lateral edges of the recording sheet P can be avoided.

Further, in this embodiment, as shown in FIG. 3, in order to avoid that the elastic pad 60A of the elastic member 60 directly slides on the pressing film 56, the low-friction sheet 72, which is a friction sheet member, is disposed so as to cover the pressing member 59. That is, the low-friction sheet 72 is provided between the pressing member 59 and the heating film 56.

The low-friction sheet 72 is a flexible sheet member formed of a heat-resistant resin material, such as polyimide, and is fixed to the leaf spring member 71 in the neighborhood of the portion 71C in which the leaf spring member 71 is fixedly supported by the stay 70. As regards the fixing of the low-friction sheet 71 to the leaf spring member 71, the leaf spring member 71 is fastened together with a press member 73 to the stay 70 with unshown screws while being shape-stabilized by the press member 73. As a result, the low-frictional sheet 72 can be fixed with a simple constitution.

The low-friction sheet 72 is provided for reducing a sliding resistance (friction resistance), and, therefore, is formed of a material (for example, a sheet formed with a fabric of fluorine-containing resin or a sheet formed of polyimide in a thin layer) having a small friction coefficient and excellent anti-wearing and heat-resistant properties.

Figure 6:
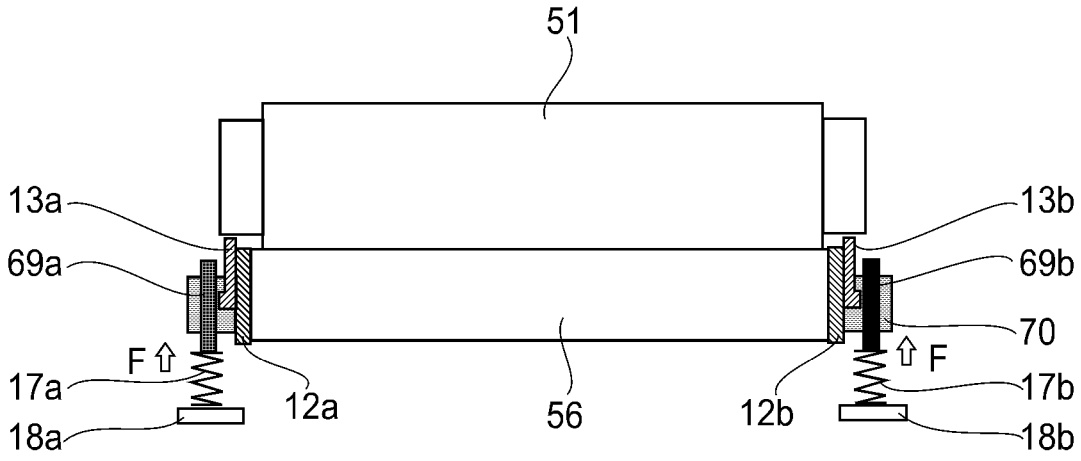
FIG. 6 is a front view of a principal part of the fixing device according to the First Embodiment.

FIG. 6 is a front view of a principal port of the fixing device 200 in this embodiment. The stay 70 supporting the leaf spring member 71 and the pressing member 59 is fixed to movable metal plates 69*a* and 69*b*. Pressing springs 17*a* and 17*b* are compressedly provided between the movable metal plate 69*a* and a spring bearing member 18*a* on a device chassis side and between the movable metal plate 69*b* and a spring bearing member 18*b* on the device chassis side, respectively, so that an urging force F is caused to act on each of the movable metal plates 69*a* and 69*b* and the pressing member 59 is pressed toward the heat roller 51, and thus, the nip N is formed. In the fixing device 200 of this embodiment, the pressure of about 100N to 250N (about 10 kgf to 25 kgf) as a total pressure is imparted.

The heat roller 51 is rotationally driven by an unshown driving means, so that a rotational force is exerted on the pressing film 56 by a frictional force between an outer surface of the heat roller 51 and an outer surface of the pressing film 56. Flange members 12*a* and 12*b* are externally fitted to left and right end portions of the pressing film 56 with respect to the longitudinal direction and are rotatably mounted to the end portions while left and right positions thereof are fixed (regulated) by regulating members 13*a* and 13*b*, respectively. The flanges 12*a* and 12*b* and the regulating members 13*a* and 13*b* perform the function of regulating (preventing) a shift (movement) of the pressing film 56 in the longitudinal direction. As a material of the flange members 12*a* and 12*b*, a high heat-resistant material, such as the LCP resin material, is preferred.

Energization to the halogen lamp 55 (FIG. 2) disposed inside the heat roller 51 is started, so that a surface temperature of the heat roller 51 is increased by heating with the halogen lamp 55. Then, at a timing (point of time) when the surface temperature is increased up to a predetermined temperature and thereafter, the recording sheet P is conveyed into the nip N and the fixing process of the toner image transferred on the recording sheet P is carried out.

Pressure Distribution of Nip

Figure 7:
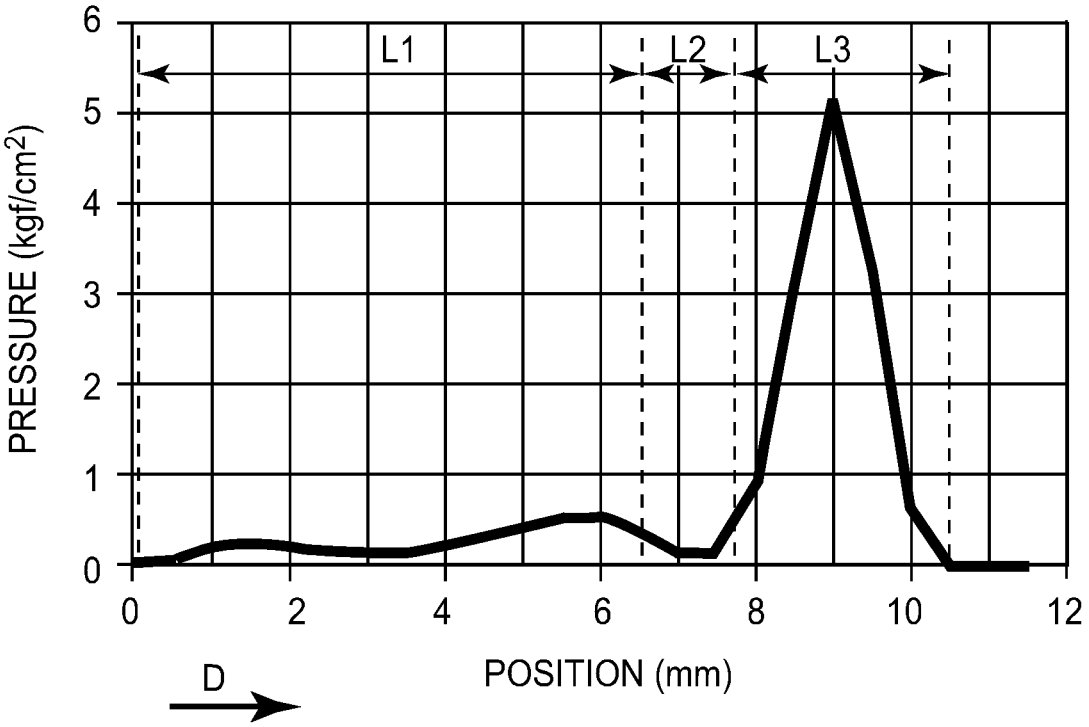
FIG. 7 is a graph showing a pressure distribution with respect to a recording material feeding direction in a nip of the fixing device according to the First Embodiment.

A pressure distribution of the nip N with respect to the recording material feeding direction in this embodiment will be described. FIG. 7 is a graph showing the pressure distribution of the nip N with respect to the feeding direction D in the fixing device 200 of this embodiment. In FIG. 7, the abscissa represents a position starting from an entrance of the nip N with respect to the recording material feeding direction D, and the ordinate represents a pressure at an associated position. A region L1, positioned on an upstream side of the nip N with respect to the feeding direction D, is a region corresponding to a nip portion formed by the pressing of the elastic pad 60A. Hereafter, the region L1 is referred to as a pre-heat portion.

The pre-heat portion L1 places the toner, transferred on the recording sheet P, in a state in which the toner (image) on the recording sheet P is increased in temperature and is easily fixed on the recording sheet P. The pre-heat portion L1 occupies a major part of a length of the nip N with respect to the feeding direction D in order to increase a passing time of the recording sheet P and to easily heat the toner. In this embodiment, the length of the pre-heat portion L1 is about 6 mm. A pressure of the pre-heat portion L1 (hereafter, this pressure is referred to as a pre-heat pressure) may only be required to be a value not less than a pressure at which heat of at least the heat roller 51 can be conducted to the recording sheet P and the toner.

When the pre-heat pressure is excessively high, the sliding resistance between the pressing film 56 and the sliding sheet 72 increases, so that a slip is liable to occur between the heat roller 51 and the recording sheet P, or between the recording sheet P and the pressing film 56. In the fixing device 200 of this embodiment, the pre-heat pressure is not more than about 1 kgf/cm$^2$ at the maximum.

A region L3, positioned on a downstream side of the recording material feeding direction D, is a region formed by the downstream jaw portion 62A and is hereafter referred to as a press portion. In the fixing device 200 of this embodiment, a length of the press portion is about 3 mm. The press portion L3 imparts a high pressure to the toner on the recording sheet P locally in the last section of a period in which the recording sheet P passes through the nip N and permits fixing of the toner on the recording sheet P. Further, the press portion L3 permits separation of the recording sheet P, on which the toner (image) is fixed, from the heat roller 51 by deformation of the elastic layer 53 and the parting layer 52 of the heat roller 51.

With a higher pressure at the press portion L3 (hereafter, this pressure is referred to as a press pressure), a sheet (paper) separating property is more improved, so that speed-up of a fixing device, in which separation of the recording sheet P is liable to become difficult, and handling of thin paper are easily realized. When the press pressure is excessively high, during continuous use of the fixing device, however, creases are liable to generate on the parting layer 52 of the heat roller 51 and the elastic layer 53 is liable to break, so that durability lowers. In the fixing device 200 of this embodiment, the press pressure is about 5 kgf/cm2 at the maximum.

With respect to the recording material feeding direction D, a region L2 sandwiched between the pre-heat portion L1 and the press portion L3 is a region corresponding to the gap G provided between the elastic pad 60A and the downstream jaw portion 62A. Hereafter, the region L2 is referred to as a gap (spacing) portion. In the fixing device 200 of this embodiment, a length of the gap portion L2 is about 1 mm.

In the gap portion L2, not only the elastic pad 60A but also a member, such as the downstream jaw portion 62A, for pressing the heat roller 51 do not exist, and is contacted to the heat roller 51 by tension of the pressing film 56, and, therefore, the pressure applied to the heat roller 51 locally lowers. With an increasing gap G between the elastic pad 60A and the downstream jaw portion 62A, the pressure of the gap portion L2 more lowers and approaches zero. In the fixing device 200 of this embodiment, the pressure of the gap portion L2 is about 0 to 0.1 kgf/cm$^2$ at the minimum.

Confirmation of Effect of this Embodiment

In order to confirm an effect of this embodiment, three kinds of fixing devices, differing in a length of the gap G between the elastic pad 60A and the downstream jaw portion 62A, were prepared and were subjected to a check of the separating property of the recording sheet P while changing the press pressure. One of the three kinds of the fixing devices is the fixing device according to this embodiment (First Embodiment) in which the gap G described above was set at 1 mm, and the remaining two fixing devices include the fixing device of Comparison Example 1 in which the gap G as set at 0.5 mm and the fixing device of Comparison Example 2 in which the gap G was set at 0 mm. As regards the length of the nip N, the length was about 10 mm in the three kinds of the fixing devices.

The press pressure, the pre-heat pressure and the pressure of the gap portion L2, which are the pressures of the nip N, were measured by a measuring system ("Inter-Roller Pressure Distribution Measuring System PINCH", manufactured by NITTA Corp.). The press pressure applied by the downstream jaw portion 62A was changed in a range of 4.5 kgf/cm$^2$ to 7.0 kgf/cm$^2$ by changing a pressing force by the pressing spring 17. Then, at each of the press pressures, the recording sheet separating property was checked, so that minimum press pressures required for separating the recording sheets P in the respective three kinds of the fixing devices were acquired and compared with each other.

As regards the pre-heat pressure applied by the elastic pad 60A, the peak pressure was set at about 1.0 kgf/cm$^2$ or less in the three kinds of the fixing devices and in the case of the respective press pressures. The pressures of the gap portion L2 in the three kinds of the fixing devices are shown in Table 1 below. As is understand from Table 1, the pressure of the gap portion L2 lowers with a decreasing length of the gap G. In this embodiment, the pressure of the gap portion L2 is about 0.0 kgf/cm$^2$ to 0.1 kgf/cm$^2$.

TABLE 1

| | Gap Length (mm) | Gap Pressure (kgf/cm$^2$) |
|---|---|---|
| First Embodiment | 1.0 | 0.0 to 0.1 |
| Comparative Example 1 | 0.5 | 0.1 to 0.2 |
| Comparative Example 2 | 0.0 | 0.2 to 0.3 |

The recording sheet separating property was evaluated depending on whether or not 30 sheets of the recording sheet P continuously passed through the fixing device 200 are separated from the heat roller 51 without being wound about the heat roller 51. When all the recording sheets were separated, the separating property was discriminated as "separation", and when even one of the recording sheets was wound or jammed due to winding, the separating property is discriminated as "winding".

A test of the recording sheet separating property was conducted under a condition in which the recording sheet P was liable to wind about the heat roller 51. As the recording sheet P, thin paper left standing in a high-temperature/high-humidity environment was used. The thin paper is lower in rigidity than general-purpose plain paper, and further lowers in rigidity when the time paper is caused to absorb moisture in the high-temperature/high-humidity environment, so that the thin paper is liable to wind about the heat roller 51.

As the recording sheet P, paper (basis weight: 60 g/m$^2$, "GF-600", manufactured by Canon K.K.) was used in a state in which a moisture content was about 9%. A print image was a pattern in which a solid image was formed in an entire area of the sheet. With an increasing toner amount, a depositing force of the toner onto the heat roller 51 is greater, so that the recording sheet P is easily wound about the heat roller 51. The toner amount was about 0.9 mg/cm$^2$ corresponding to a state of superposed two color toners. As regards a leading end margin, the toner is positioned closer to a leading end of the paper (sheet) with a shorter leading end margin, and thus, the paper is liable to wind about the heat roller 51. In the test of the separating property, the leading end margin was about 3 mm.

Table 2 below shows a result of evaluation of the paper (sheet) separating property under application of respective press pressures in the fixing devices in First Embodiment, the Comparison Example 1, and the Comparison Example 2. In Table 2, "○" represents that the recording sheet was separated "separation", and "x" represents that the recording sheet was wound about the heat roller 51 ("winding").

TABLE 2

| | GL*1 | Press Pressure (kgf/cm$^2$)*2 | | | | |
|---|---|---|---|---|---|---|
| | (mm) | 4.5 to 5.0 | ≤5.5 | ≤6.0 | ≤6.5 | ≤7.0 |
| First Embodiment | 1.0 | ○ | ○ | ○ | ○ | ○ |
| Comparative Example 1 | 0.5 | x | x | x | ○ | ○ |
| Comparative Example 2 | 0.0 | x | x | x | x | ○ |

*1"GL" is the gap length.
*2Ranges of the press pressure (kgf/cm$^2$) are as follows.
"4.5-5.0": from 4.5 to 5.0.
"≤5.5": from more than 5.0 to not more than 5.5.
"≤6.0": from more than 5.5 to not more than 6.0.
"≤6.5": from more than 6.0 to not more than 6.5.
"≤7.0": from more than 6.0 to not more than 7.0.

In the constitution of "gap length of 1.0 mm" in the First Embodiment, in the range of the press pressure from 4.5 kgf/cm$^2$ to 7.0 kgf/cm$^2$, the recording sheets P were separated and a good result was achieved. On the other hand, in the constitution of "gap length of 0.5 mm in Comparison Example 1", in the range of the press pressure from 4.5 kgf/cm$^2$ to 6.0 kgf/cm$^2$, the winding of the recording sheet generated, and in the range from more than 6.0 kgf/cm$^2$ to not more than 7.0 kgf/cm$^2$, the recording sheet P was separated. Further, in the constitution of "gap length of 0.0 mm in Comparison Example 2", in the range of the press pressure from 4.5 kgf/cm$^2$ to 6.5 kgf/cm$^2$, the winding of the recording sheet P generated, and in the range from more than 6.5 kgf to not more than 7.0 kgf/cm$^2$, the recording sheet P was separated. From these results, it is understood that the press pressure required to separate the recording sheet P can be made smaller with an increasing gap length (gap amount).

By providing the gap G, as in this embodiment, a high-pressure portion (region L3 of FIG. 7) generates immediately after the pressure applied to the nip is lowered (region L2 of FIG. 7), and, therefore, a pressure difference between the low-pressure region and the high-pressure region becomes very large. Such an abrupt pressure change generates, and, therefore, it would be considered that a slip generates in the nip between the toner and the heat roller 51 and thus, the recording material is easily separated from the heat roller 51.

As described above, when the constitution in which the gap G is provided between the elastic pad 60A and the downstream jaw portion 62A is employed, the press pressure can be lowered while maintaining the recording sheet separating property, and, therefore, the durability of the fixing device 200 can be improved.

Second Embodiment

A fixing device according to a Second Embodiment of the present invention will be described using FIG. 8, which is a schematic cross-sectional side view of the fixing device. This embodiment is different from the First Embodiment in the constitution of the pressing member 59. Constitutions of portions (members) of the fixing device other than the pressing member 59 are the same as those in the First Embodiment and, therefore, will be omitted from description.

Similarly as in the First Embodiment, the pressing member 59 is constituted by the elastic pad member 60 and the pad holder 62, and the gap G is provided therebetween. By this gap G, similarly as in the First Embodiment, the peak pressure necessary to separate the recording sheet P is lowered, so that the recording material separating property and the durability can be compatibly realized.

A positioning constitution of the elastic pad 60A for ensuring the gap G is different from the First Embodiment. In the First Embodiment, as shown in FIG. 3, the pad supporting plate 60B was contacted to the gap rib 62D (positioned upstream of the downstream jaw portion 62A) provided on the pad holder 62, so that the gap G between the elastic pad 60A and the downstream jaw portion 62A was ensured.

Figure 8:
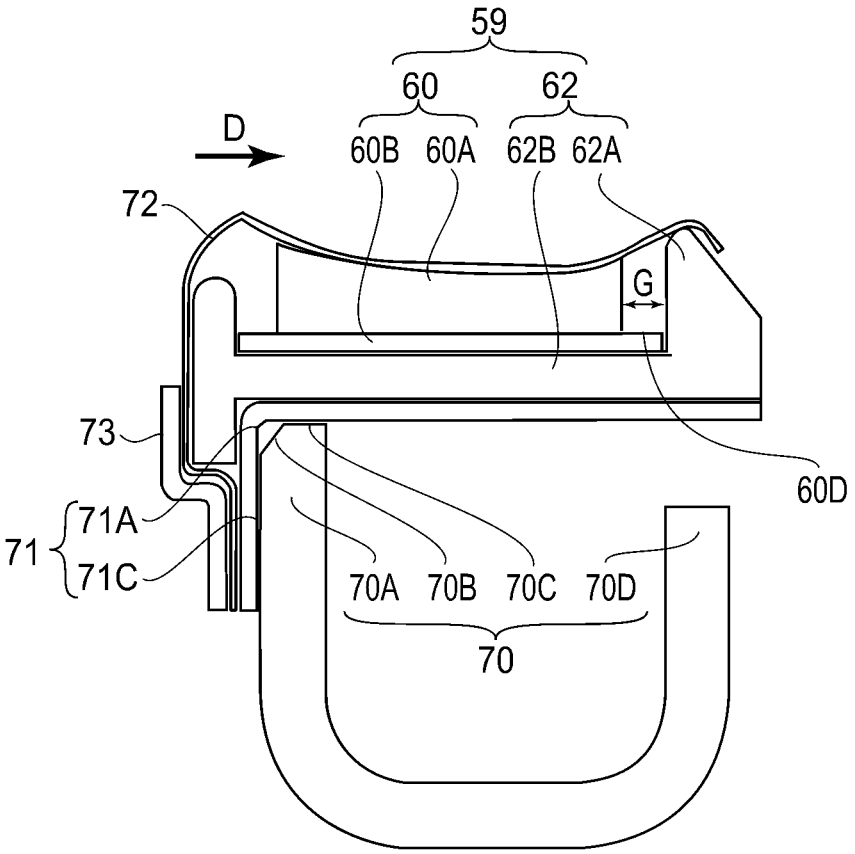
FIG. 8 is a cross-sectional side view of a fixing device according to a Second Embodiment.

In this embodiment, as shown in FIG. 8, no gap rib 62D is provided, and in place thereof, a downstream end of the elastic pad 60A forming the gap G is provided inside (upstream) of a downstream end of the pad supporting plate 60B with respect to the recording material feeding direction D. Further, the pad supporting plate 60B is provided with a marginal portion 60D, on which the elastic pad 60A does not exist, on the downstream side of the pad supporting plate 60B, so that the gap G is ensured. That is, in this embodiment, the pad supporting plate 60B is constituted to the downstream jaw portion 62A, so that the gap G between the elastic pad 60A and the downstream jaw portion 62A is ensured.

Figure 9:
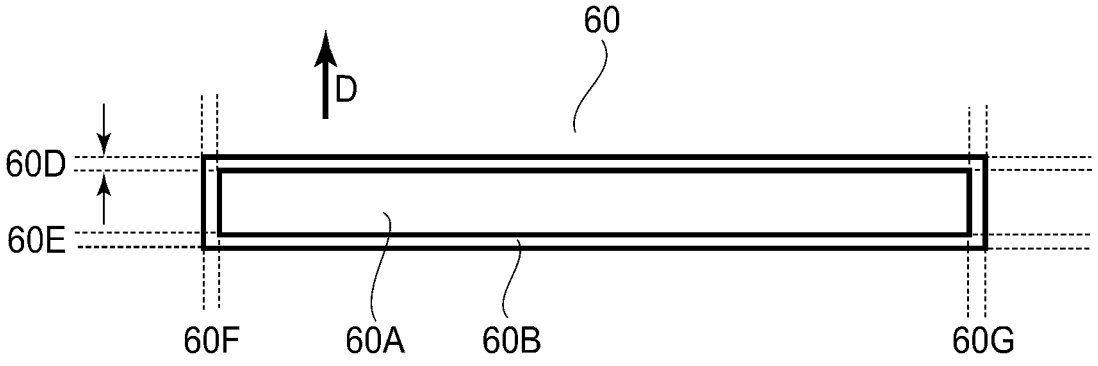
FIG. 9 is a top plan view of an elastic pad of the fixing device according to the Second Embodiment.

FIG. 9 is a top plan view of the elastic pad member 60 in this embodiment. As a further feature of this embodiment, the elastic pad member 60 is provided with not only the marginal portion 60D on the downstream side thereof with respect to the recording material feeding direction D, but also marginal portions 60E, 60F and 60G disposed on the pad supporting plate 60B so as to surround the entirety of the elastic pad 60A in combination with the marginal portion 60D.

The elastic pad member 60 in this embodiment is prepared by integrally molding the elastic pad 60A on the pad supporting plate 60B. The elastic pad member 60 prepared by the integral molding is specifically prepared by injecting a material of the elastic pad 60A into a metal mold in which the pad supporting plate 60B is disposed in advance. For this reason, as compared with the case in which the elastic pad 60A is bonded to the pad supporting plate 62A, positional accuracy of the elastic pad 60A relative to the pad supporting plate 62A can be enhanced.

Further, as shown in FIG. 8, the elastic pad member 60 is abutted against and positioned relative to the downstream jaw portion 62A, with the result that accuracy of a length of the gap G between the elastic pad 60A and the downstream jaw portion 62A can be enhanced.

An effect of the marginal portions 60D, 60E, 60F and 60G of the elastic pad member 60 in this embodiment will be further described. In the case in which the elastic pad member 60 is integrally molded, during the injection, there was a problem that a part of the material of the elastic pad 60A was liable to move around the pad supporting plate 60B to reach the back side of the pad supporting plate 60B. When the port of the material of the elastic pad 60A moves around the pad supporting plate 60B to reach the back side of the pad supporting plate 60B, a layer of the material of the elastic pad 60A having a non-uniform thickness exists between the elastic pad member 60 and the pad receiving portion 62B of the pad holder 62.

As a result, a problem that a position of the elastic pad member 60 relative to the downstream jaw portion 62A with respect to a height direction becomes unstable and thus, the pre-heat pressure is liable to fluctuate arose. In order to avoid this problem, there is a need to provide a removing step of removing the material moving around the pad supporting plate 60B to reach the back side of the pad supporting plate 60B after the molding. Further, an amount of the material to be injected into the mold for forming the elastic pad 60A is also liable to vary, and, therefore, there is a problem that a quality problem, such as a void of the elastic pad 60A due to an insufficient amount of the material is liable to arise.

On the other hand, in this embodiment, on the pad supporting plate 60B, at an entirety of the periphery of the elastic pad 60A, the marginal portions 60D, 60E, 60F and 60G are formed. In this embodiment, not only during the integral molding, the pad supporting plate 60B and the metal mold can be press-contacted to each other, but also during the injection of the material, leakage of the material of the elastic pad 60A can be eliminated (avoided). As a result, the injection material is prevented (suppressed) from moving around the pad supporting plate 60B to reach the back side of the pad supporting plate 60B. Each of these marginal portions may desirably be ensured so as to have a width of 0.5 mm or more. In this embodiment, all the marginal portions 60D, 60E, 60F and 60G provided on the downstream side, the upstream side, the longitudinal left side, and the longitudinal right side have the width of 1 mm.

As described-above, when the constitution in which the marginal portions are provided on the pad supporting plate 60B so as to surround the elastic pad 60A is employed, the integral molding can be realized while preventing the injection material from moving around the pad supporting plate 60B to reach the back side of the pad supporting plate 60B, so that an improvement in distance accuracy of the gap G can be realized.

As described-above, when the constitution in which the gap G is provided between the elastic pad 60A and the downstream jaw portion 62A is employed, the press pressure can be lowered while maintaining the recording sheet separating property, and, therefore, the durability of the fixing device 200 can be improved.

Modified Embodiments

In the above description, preferred embodiments of the present invention were described, but the present invention is not limited thereto, and can be variously modified and changed within the scope of the present invention. Further, dimensions, materials, shapes, and the relative arrangement of constituent component parts described in the embodiments mentioned above should be appropriately changed depending on structures and various conditions of the devices to which the present invention is applied, and the scope of the present invention is not limited thereto.

Modified Embodiment 1

In the above described embodiments, the elastic pad 60A is supported by the pad receiving portion 62B through the pad supporting plate 60B, but a constitution in which the elastic pad 60A is directly supported by the pad receiving portion 62B, without being supported through the pad supporting plate 60B, can also be employed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fixing device comprising:

(A) a rotatable member;

(B) a rotatable endless belt contacting a surface of said rotatable member;

(C) a pad provided in an inside space of said endless belt and configured to press said rotatable member through said endless belt;

(D) a holder configured to hold said pad at a side opposite from a side on which said pad opposes said rotatable member, said holder including:

(a) a first portion provided at a position in which a recording material is separated from said rotatable member with respect to a recording material feeding direction, and, with respect to the recording material feeding direction, a gap is provided between said pad and said first portion; and (b) a second portion that holds said pad and that extends in the recording material feeding direction; and (E) a leaf spring member configured to urge said holder toward said rotatable member, wherein, between said rotatable member and said endless belt, a nip, in which the recording material, carrying a toner image thereon, is nipped and fed, is formed by sandwiching said endless belt between said rotatable member and said pad, and the toner image is fixed on the recording material in the nip.

2. The fixing device according to claim 1, wherein, with respect to the recording material feeding direction, a width of the gap is 0.8 mm to 2 mm.

3. The fixing device according to claim 1, wherein, when said pad and said holder are demounted from said fixing device, a height of said pad in a direction toward said rotatable member is less at a downstream end portion of said pad with respect to the recording material feeding direction than a height of said holder at said first portion.

4. The fixing device according to claim 1, wherein said holder includes a spacer portion configured to form the gap, and said spacer portion projects in a direction toward said rotatable member more than does a region of said holder in which said holder holds said pad.

5. The fixing device according to claim 1, further comprising (F) a pad supporting member configured to support said pad, wherein said holder holds said pad through said pad supporting member.

6. The fixing device according to claim 5, wherein said pad supporting member includes a marginal portion extending from a downstream end portion of said pad toward a downstream side with respect to the recording material feeding direction, and the gap is formed by said marginal portion.

7. The fixing device according to claim 6, wherein, when said pad is viewed from a rotatable member side, said marginal portion of said pad supporting member is provided on an entirety of a periphery of said pad.

8. The fixing device according to claim 1, wherein said leaf spring member has a comb-teeth shape such that, with respect to a direction perpendicular to the recording material feeding direction, a portion of said leaf spring member urging said holder is divided into a plurality of urging portions movable independently of each other.

9. The fixing device according to claim 8, wherein, with respect to the recording material feeding direction, said leaf spring member is fixed at an upstream end portion thereof, and a downstream portion of said leaf spring member is divided into the plurality of urging portions.

10. The fixing device according to claim 9, further comprising (F) a stay provided in an inside space of said endless belt and configured to reinforce said fixing device, wherein said leaf spring member is fixed to said stay.

11. The fixing device according to claim 1, wherein said pad is constituted by an elastic member.

12. The fixing device according to claim 11, further comprising (F) a flat plate member formed of metal and configured to support said pad, wherein said pad is held by said holder through said flat plate member.

* * * * *